US005890280A

United States Patent [19]

Matsuzawa

[11] Patent Number: 5,890,280

[45] Date of Patent: Apr. 6, 1999

[54] DEVICE FOR POSITIONING ELECTRIC WIRE WITHIN A TERMINAL APPLICATION DEVICE

[75] Inventor: Susumu Matsuzawa, Yokkaichi, Japan

[73] Assignee: Sumitomo Wiring Systems, Ltd., Yokkaichi, Japan

[21] Appl. No.: 990,739

[22] Filed: Dec. 15, 1997

[30] Foreign Application Priority Data

Dec. 16, 1996 [JP] Japan ..... 8-335963

[51] Int. Cl.[6] ..... H01R 43/048

[52] U.S. Cl. ..... 29/753; 29/33 M; 29/760; 29/863; 72/712

[58] Field of Search ..... 29/33 M, 753, 29/760, 861, 863; 72/416, 712; 100/257

[56] References Cited

U.S. PATENT DOCUMENTS

| | | | |
|---|---|---|---|
| 3,668,764 | 6/1972 | Randar | 29/753 |
| 3,875,662 | 4/1975 | Folk | 29/753 X |
| 4,246,771 | 1/1981 | Covill et al. | 29/753 X |
| 4,896,419 | 1/1990 | Jürgenhake et al. | 29/861 |
| 5,074,033 | 12/1991 | Dassance et al. | 29/753 |
| 5,353,625 | 10/1994 | Hoshino et al. | 72/416 |
| 5,661,898 | 9/1997 | Matsuzawa | 29/760 X |
| 5,745,982 | 5/1998 | Klinedinst | 29/760 X |

FOREIGN PATENT DOCUMENTS

| | | | |
|---|---|---|---|
| 0332815 | 9/1989 | European Pat. Off. | 29/861 |
| 0717475 | 6/1996 | European Pat. Off. | 29/753 |
| 8167466 | 6/1996 | Japan | 29/753 |
| 1315502 | 5/1973 | United Kingdom | 29/753 |

*Primary Examiner*—Peter Vo
*Attorney, Agent, or Firm*—Greenblum & Bernstein P.L.C.

[57] ABSTRACT

An apparatus for positioning an electric wire within a terminal application system for installing an electric terminal on an electric wire, includes at least one claw, having an axis of rotation and a longitudinal axis extending generally transversely from the axis of rotation, and connected to the shank holder through the axis of rotation so that the claw is free to rotate about the axis of rotation with respect to the shank holder while connected to the shank holder, and being rotatable from a wire positioning condition to an open condition. A support member connected to the shank, supporting the claw and allowing the claw to move from the open condition to a wire positioning condition when the shank and moveable mold are moved toward the stationary mold is also included. Biasing members, such as springs, may also be included.

21 Claims, 5 Drawing Sheets

Prior Art

Prior Art

DEVICE FOR POSITIONING ELECTRIC WIRE WITHIN A TERMINAL APPLICATION DEVICE

BACKGROUND OF THE INVENTION

1. Field of the Invention

This invention relates to a device for properly positioning the end-portion of an electric wire within a device for installing terminals or terminal fittings on electric wire.

2. Description of Background Information

Terminals or terminal fittings are generally installed on the ends of electric wires by automated or semi-automated equipment for doing so in mass production fashion. In such systems, it is necessary to ensure that the end portion of the wire upon which the terminal is to be installed is positioned within the device as accurately as possible, so that a terminal or terminal fitting may be installed properly on the end of the wire.

In general, terminal application devices for clamping terminal fittings on the end portion of a covered or insulated electric wire which is cut and treated with a stripping process include systems for processing electric wire by which the covered electric wire is measured and cut, and both ends of the covered electric wire so cut are continuously processed.

Such terminal application devices typically further include a device in which a pair of molds, for separately cutting terminal fittings from a continuous terminal belt and clamping them, co-operate as a unit, and are constituted so that the end portion of the covered electric wire supplied by a supply unit of electric wire installed at the above-mentioned device for processing electric wire is positioned and the terminal fittings are clamped with this system.

In such systems, the supply unit for electric wire, in the device for processing an electric wire, feeds the end portion of the covered electric wire between the above-mentioned pair of molds by swinging the end portion of the covered electric wire which is in a free state. Under such conditions, it is difficult to properly position the covered electric wire against these pair of molds and this often results in the inferior clamping or installation of terminals on such wires. Therefore, the present applicant has previously proposed a device for accurately positioning an electric wire (i.e., remedying an electric wire posture) enabling one to exactly position the end portion of a covered electric wire which is supplied by the supply unit for electric wire, between a pair of molds. In this connection, reference is made to U.S. Pat. No. 5,661,898, which is hereby expressly incorporated by reference herein in its entirety.

Further in this regard, FIG. 4 of the present application is a front schematic illustration of a device for remedying an electric wire posture adapted to a conventional terminal application device A.

As shown in FIG. 4, conventional terminal application device A is integrally equipped with a mold of a fixed side 1 and a mold of a mobile side 2 fixing terminal fittings (which are not shown in this Figure) on an end portion of a stripped wire W1 for a covered electric wire W. The terminal fittings are applied by mold 1 in cooperation with, a shank 3, integrally supporting the mold of mobile side 2, and a shank holder 4 positioning the mold of mobile side 2 at the mold of fixed side 1 by being integrally installed with the mold of fixed side 1 and by guiding the above-mentioned shank 3 in a state where relative change between the mold of fixed side 1 and mold of a mobile side 2 is possible.

In front of the mold of fixed side 1, a wire guide 5 which receives the neighboring part of the end portion of a stripped wire W1 for a covered electric wire W is installed, and the covered electric wire W is mounted on the above-mentioned wire guide 5 by swinging the covered electric wire W with a supply unit of an electric wire (which is not shown in the Figure), as shown by arrow B. The end portion of a stripped wire W1 is arranged to be supplied between the mold of fixed side 1 and the mold of mobile side 2.

Further, in the above conventional device for remedying an electric wire posture, a claw 6 is provided, for accurately positioning (i.e., remedying the posture of) a covered electric wire W on the shank holder 4 in a state in which the claw can rotate about a support axis 7. A rack gear 8 on shank 1, and a pinion gear 9 which meshes with the rack gear 8, cooperate to correct the posture (or positioning) of the covered electric wire W which was supplied by linking the up-down motion of a shank 3, by means of claw 6.

However, as pinion gear 9 and rack gear 8 have been used to link the shank 3 with the claw 6 in the conventional device for remedying an electric wire posture, it was necessary to provide a space for accommodating the rack gear 8 on the shank 3 of the terminal application device. Therefore, this system has a disadvantage in that more intensive manufacturing is required in order to provide a system including a shank 3 and shank holder 4 and including a rack gear 8, depending on the kinds of the terminal application devices employed. Additionally, in the case where a kind of device on which a cover plate for covering the shank 3 on the shank holder 4 is installed, the rack gear 8 may not be installed at all, because of the interference of the cover plate. Therefore, a further disadvantage is that when the claw 6 is linked with the up-down motion of the shank 3, the types of terminal application devices which can be suitably employed are greatly restricted.

Further, when the rack gear 8 and the pinion gear 9 are set, the rack gear 8 is fixed on the side part or the front of the set-plate 3A installed on the front of the shank 3. Therefore, claw 6 is separated from mold 1 by the dimension L in an axial direction of the support axis 7.

This relationship and spacing is also shown in schematic cross-section in FIG. 5. The assembly of FIG. 5 is also constructed and arranged to include a magnetic slip system, which is discussed in greater detail in U.S. Pat. No. 5,661,898, incorporated by reference above, and which is also expressly incorporated by reference herein in its entirety for its disclosure of the magnetic slip assembly which may be employed in its system. In the present FIG. 5, the distance L of FIG. 4 is schematically illustrated by the distance L' of FIG. 5, which is the distance between surface 30 and claw 60.

In view of the foregoing, it has been difficult to set a position for inserting an electric wire by the claw 6 to a desired position. That is, in order to accurately remedy the posture of the covered electric wire W, it has been preferred to provide the claw 6 between the above-mentioned mold of the fixed side 1 and the wire guide 5 prior to the positioning of the covered electric wire W, but as the claw 6 is set forward by the dimension L to an axial direction of the rack gear 8 and the pinion gear 9, it has been difficult to locate claw 6 in between the mold 1 and the wire guide 5.

Therefore, it has been necessary to carry out a folding process where the claw 6 must swing to the axial direction of the support axis 7 in order to displace the claw 6 between the mold 1 and the wire guide 5. As a result, the disadvantage has existed that the installation cost of the claw 6 becomes not only high but also operation is difficult, because it is easy to interfere with surrounding members because of the need to move claw 6 in the axial direction.

Further, as the claw 6 is rotated with the rack gear 8 and the pinion gear 9, the claw 6 could not adequately open the supply pass of the covered electric wire W because of the restriction of the stroke and the number of gear teeth of the rack gear 8. Therefore, such systems posses the further disadvantage that a restriction occurs in the supply device for supplying the covered electric wire W to the terminal application device, and further the wide usability is lost.

In addition, rack gear 8 and pinion gear 9 are relatively expensive, and, therefore, production costs for systems employing them have been high.

SUMMARY OF THE INVENTION

In view of these and other difficulties associated with such systems, the present invention provides a device for accurately positioning an electric wire having a wide range of usability and allowing for the correction of the positioning, e.g., remedying the posture of a covered electric wire W at a relatively low cost.

In accordance with the foregoing, in one aspect the invention provides an apparatus for positioning an electric wire within a terminal application system for installing an electric terminal on an electric wire. In this system, the terminal application system comprises a stationary mold, a movable mold connected to a shank member for moving the moveable mold and capable of moving the moveable mold toward the stationary mold, and a shank holder for holding the shank member while allowing relative movement between the shank member and the shank holder.

The apparatus for positioning an electric wire further comprises at least one claw, having an axis of rotation and a longitudinal axis extending generally transversely from the axis of rotation, and being connected to the shank holder through the axis of rotation so that the claw is free to rotate about the axis of rotation with respect to the shank holder while connected to the shank holder, and being rotatable from a wire positioning condition to an open condition; and a support member connected to the shank, supporting the claw and allowing the claw to move from the open condition to the wire positioning condition when the shank and moveable mold are moved toward the stationary mold.

In some embodiments, the shank comprises a longitudinal axis, and the shank and moveable mold are moved along an axis of movement when moved toward the stationary mold, which axis is generally parallel to the longitudinal axis of the shank, and the apparatus for positioning the electric wire comprises at least a first and second claw, the first claw being connected to the shank holder at a first side of the longitudinal axis of the shank, and the second claw being connected to the shank holder at a second side of the longitudinal axis of the shank.

In other preferred embodiments, the first claw and the second claw are generally symmetrically disposed on opposite sides of the longitudinal axis of the shank.

In other preferred embodiments, the claw is biased toward the closed position, preferably by one of gravity, a torsion spring, a spring at least partially encircling the axis of rotation of the claw, a tension spring, or any of various combinations of the foregoing.

The tension spring may have an axis which is generally transverse to the axis of rotation of the claw. In such embodiments, the shank may have a longitudinal axis and the axis of the tension spring may be generally parallel with the longitudinal axis of the shank.

Additionally, the support member may comprise a generally U-shaped gaff.

In another aspect, the invention provides an apparatus for positioning an electric wire within a terminal application system for installing an electric terminal on an electric wire, wherein the terminal application system comprises a stationary mold, a movable mold connected to a shank member for moving the moveable mold and capable of moving the moveable mold toward the stationary mold, the shank member having a first side and a second side, and a shank holder for holding the shank member at the first and second sides of the shank member while allowing relative sliding movement between the shank member and the shank holder. In this aspect, the apparatus for positioning an electric wire comprises at least one claw, having an axis of rotation and a longitudinal axis extending generally transversely from the axis of rotation, and being connected to the shank holder through the axis of rotation so that the claw is free to rotate about the axis of rotation with respect to the shank holder while connected to the shank holder, and being rotatable from a wire positioning condition to an open condition.

A support member connected to the shank supports the claw and allows the claw to move from the open condition to the wire positioning condition when the shank and moveable mold are moved toward the stationary mold.

The shank holder may comprise a first portion receiving the first side of the shank and a second portion receiving the second side of the shank, and the apparatus for positioning the electric wire may comprise at least a first and second claw, wherein the first claw is connected to the first portion of the shank holder and the second claw is connected to the second portion of the shank holder.

Preferably, the first and second claws are biased toward the closed position by at least one member selected from gravity, a torsion spring, a tension spring and combinations thereof.

The torsion spring may at least partially encircle the axis of rotation of the claw. The tension spring may comprise an axis which is generally transverse to the axis of rotation of the claw.

The support member may comprise a gaff.

Thus, in some embodiments, in order to solve the above-mentioned problems, the present invention provides a device for accurately positioning an electric wire (also referred to herein as remedying the posture of an electric wire) on which a terminal is to be installed at a terminal application device equipped with a stationary mold, a moveable mold fixing a terminal fitting on an end portion of a stripped wire for a covered electric wire in co-operation with the mold, a shank integrally supporting the moveable mold and a shank holder positioning the moveable mold at the stationary mold by being integrally connected to the moveable mold and by guiding the above-mentioned shank in a state where relative movement between the shank and shank holder is possible, thus allowing the moveable mold to be moved toward the stationary mold. The device for remedying an electric wire posture comprises a support axis which is installed on the above-mentioned shank holder.

A claw is capable of being rotationally displaced to an open posture (or first position) for permitting the end portion of a stripped wire for a covered electric wire to be inserted and extracted between the both molds, and a remedy posture (or second position) for accurately positioning the end portion of a stripped wire for a covered electric wire so that it assumes a posture enabling the end portion to be positioned. This is accomplished by installing the claw so as to be able to freely rotate around the support axis.

Additionally, a linkage system is preferably provided which links the movement of the claws with a clamping motion in order to displace the claws to a remedy posture during a process of clamping a terminal on a wire end and displacing the claws to the open posture when both molds are opened or moved apart. Preferably, the linkage system has link wires which comprise an integral main body part extending along the above-mentioned shank, a fixed part formed on one end portion of the main body part and fixed on the above-mentioned shank, and link-wires which are formed on the other end portion of the main body part and a hanging part which hangs around at free end parts of the claws in order to displace the above-mentioned claws between the open posture and the remedy posture along the main body part.

In such embodiments of the invention, the end portion of a covered electric wire supplied can be positively positioned by displacing the claws to an open posture and to a remedy posture by the link-wires. As the link-wires have a main body part set along a shank and a hanging part hanging with the claws so that the claws are displaced to the open posture and the remedy posture along the main body part, it is possible to accurately position the covered electric wire in a state in which the claws approach each other as nearly as possible. Further, as the hanging part of the link-wires hang with a neighboring part of the free edges of the claws, it is possible to settle a big rotational stroke of the claws.

Further, in a preferred embodiment, the above-mentioned claws are symmetrically arranged on the axis along the mobile or longitudinal direction of the shank and form a pair, and the respective claws remedy the posture of the end portion of the stripped wire of the covered electric wire by nipping the covered electric wire between the claws.

In such embodiments of the invention, as the pair of claws mutually nips the covered electric wire at the remedy posture for remedying the posture of the covered electric wire, the respective claws can position the covered electric wire without dependence on the members already set on the terminal application device.

Further, in other preferred embodiments, the invention comprises a device for remedying an electric wire posture wherein setting members for always setting the above-mentioned claws at the remedy posture are further installed.

In such embodiments, the link-wires can carry out a desired motion by permitting the displacement of claws at the remedy posture at the time of clamping the terminal fittings. Further, as the claws are always set at the remedy posture, the link-wires keep the claws at the remedy posture by coping with this setting force, therefore the claws are hardly removed from the hanging part of the link-wires.

BRIEF DESCRIPTION OF THE DRAWINGS

The foregoing and other aspects, features, and advantages of the invention will be apparent from the following more particular description of the preferred embodiment as illustrated in the accompanying drawings in which reference characters refer to the same parts throughout the various views, and wherein.

DETAILED DESCRIPTION OF PREFERRED EMBODIMENTS OF THE INVENTION

Figure 1:
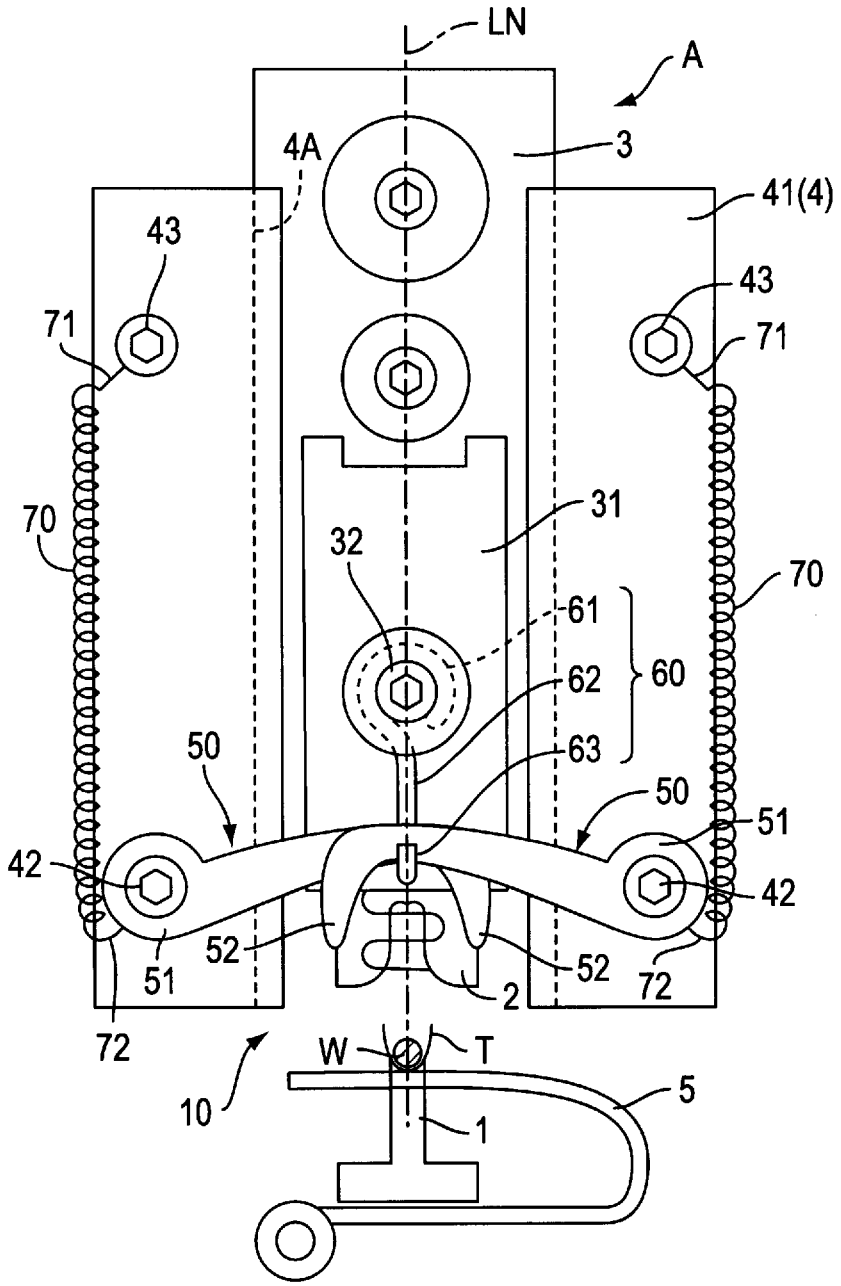
FIG. 1 is a front schematic view showing a device for positioning an electric wire, in which the claws are at the open position, in one mode of operation of the present invention.
Figure 2:
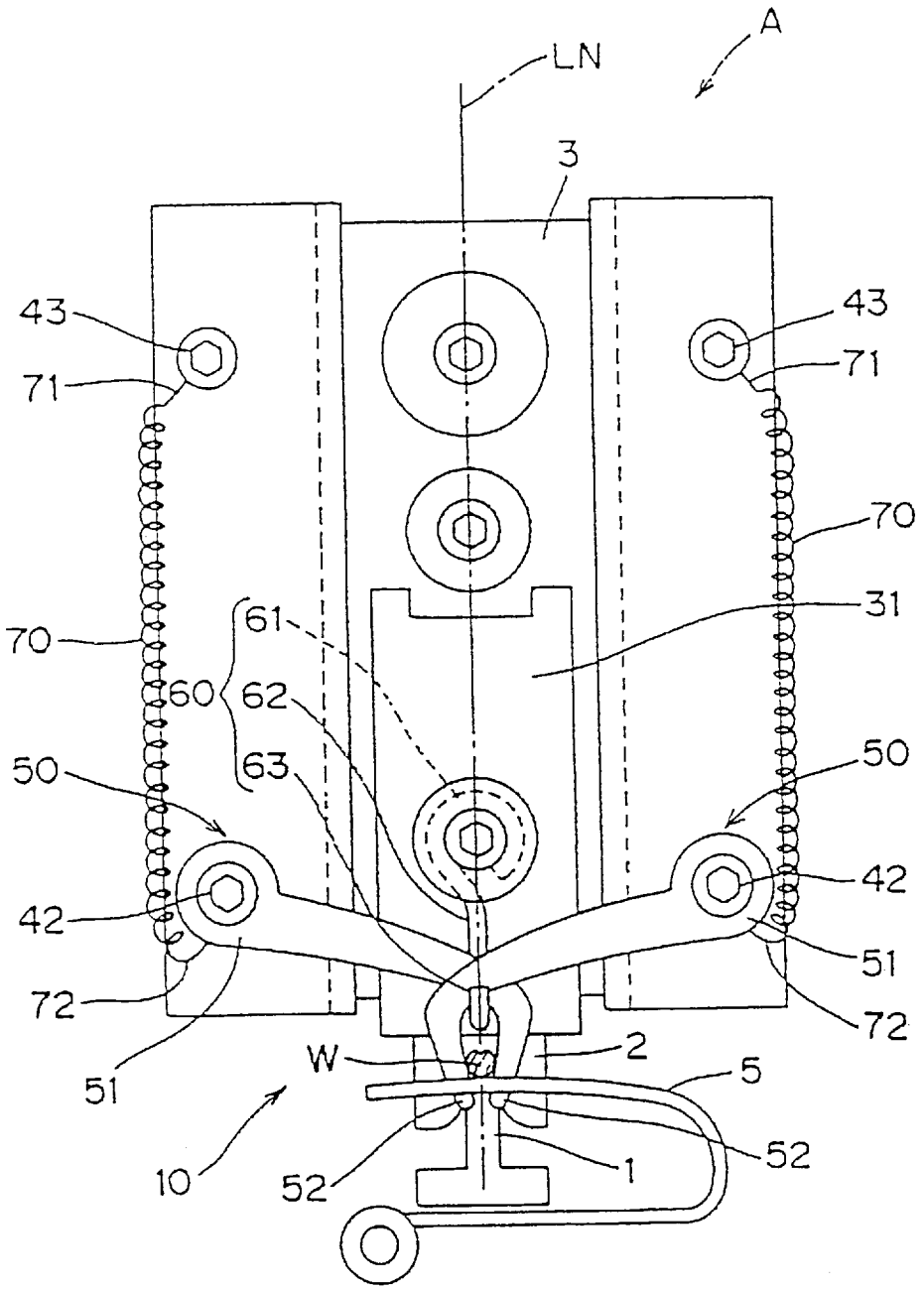
FIG. 2 is a front schematic view of the device of FIG. 1 for positioning an electric wire, in which the claws are at the "remedy" posture, in one mode of operation of the present invention.

With reference to FIGS. 1 and 2, the shank holder 4 of the conventional terminal application device A in the example shown in the Figures stores the shank 3 in the track 4A which preferably takes a shape of a generally channel shaped member in top plan view, and a pair of cover plates 41 are fixed by bolts 42, 43 with hexagonal holes in the front portion thereof. Respective cover plates 41 are preferably of a rectangular shape which extends vertically, and the bolts 42, 43 are separately arranged at spaced vertical locations in cover plates 41 and screwed in screw holes of the shank holder 4 which are not shown in the Figures.

Respective bolts 42 arranged under the cover plates 41 serve as the support axis of the device for remedying an electric wire device, 10 of the example shown in the Figures, and respectively support the base end portions of the claws 50 of the device 10 which can rotate around the bolts.

The device 10 for accurately positioning an electric wire is preferably equipped with the above-mentioned pair of claws 50, link-wires 60 for linking the respective claws 50 with the shank 3, and the setting members 70 which are installed at the respective claws 50 and biases the respective corresponding claws 50 in a fixed direction.

The above-mentioned pair of claws 50 are mutually and symmetrically arranged by taking the central line LN of the shank 3 as an axis, and preferably comprise a thin member formed from a relatively hard resin. The respective end portions of the free end portions 52 of the respective claws 50 are formed in a hook shape which are bent downward in a generally L-shaped fashion. The free end portions 52 mutually cross each other at the central line LN. Therefore, in the embodiment shown in FIGS. 1 and 2, the free end portions 52 are mutually separated and displaced to the open posture with the mold of fixed side 1 and the mold of mobile side 2 being located between the respective free end portions by rotating around the bolts 42 to a direction where the respective free end portions 52 are in an upward position. Thus, the free end portions are retained from a free-fall condition by link wires 60. At the same time, they are designed to be displaced to the remedy position (as shown for example, in FIG. 2) for remedying the posture of the covered electric wire W by falling in a direction reverse to the above-mentioned direction and nipping the neighboring part of the end portion of stripped wire of the covered electric wire W which is put on the wire-guide 5 while the shank is being pushed downward.

The above-mentioned link-wires are preferably steel members integrally having a generally ring-shaped portion 61 which is locked in combination with the bolts 32 fixing the set-plate 31 which is arranged at the front face of the shank 3 on the shank 3. The link wires also preferably comprise a main body part 62 which hangs downward from the ring part 61, preferably along the above-mentioned center line LN. The link wires also preferably comprise a gaff portion 63 having a generally U shape, which is formed under the edge of the main body part 62 and hooks the neighboring part of the free end portions 52 of the respective claws 50. Further, the respective claws 50 are kept at the open posture in a state in which the downward displacement, that is, the displacement to the regulated posture of FIG. 2 is regulated, by respectively being hooked at the hooking part 63 of the link-wires 60 at the above-mentioned center line LN. Thus, in the example shown in FIGS. 1 and 2, as the respective claws 50 are hooked on the hooking part 63 so that the respective claws 50 are displaced along the main body part 62 when the main body part 62 of the link-wires 60 hangs down along the shank 3 and the respective claws 50 are displaced between the open posture and the remedy posture, the respective claws 50 can be displaced so that the free end portions 52 are positioned as closely together as possible, and as a result, the posture of the covered electric wire W can be remedied by putting the claws 50 between the mold of fixed side 1 and the wire guard 5 as shown in FIG. 2.

In the example shown in FIGS. 1 and 2, the above-mentioned setting members 70 preferably comprise a tension coil spring. One of the end parts 71 of the setting members 70 is preferably fixed at bolt 43 which fixes the upper side of the cover plate 41 and the other of the end parts 72 extends downward and is fixed at the base end portions 51 of the claws 50. Further, as the setting members 70 always set the claws 50 to the remedy posture, the neighboring parts of the free end portions of the respective claws 50 are in a state in which they are pushed down to the hooking part 63 of the link-wires 60 by a biasing force of the setting members 70.

In the above-mentioned preferred embodiment, as shown in FIG. 1, when the shank 3 is moved upwardly and both the molds 1 and 2 are opened, the respective claws 50 thoroughly open the space between the both molds 1 and 2 by hanging up the neighboring parts of the end portions of the respective claws 50 of the device 10 with the hooking part or gaff 63 of the link-wires 60. In this state, when the clamping process starts (for example, when the movable mold is moved toward the stationary mold) and the shank 3 comes down, the free end portions 52 descend by the biasing force of the setting members 70 while the base end portions 51 rotate around the bolts 42 in accordance with integrated descent of the link-wires 60 installed on the shank 3. Therefore, the respective free end portions 52 mutually nip the neighboring part of the end portion of stripped wire of the covered electric wire W on the center line LN just before the terminal fittings T are clamped, and the respective claws 50 remedy the posture of the covered electric wire W (as shown in FIG. 2). Thus, as the link-wires 60 have the main body part 62 arranged along the shank 3 and the hooking part 63 hooks the claws 50 so that the claws 50 are displaced to the open posture and the remedy posture along the link-wires 60, the remedy motion of the covered electric wire W can be carried out in a state in which the claws 50 approach both molds 1 and 2, and each other, as nearly as possible. Further, as the above-mentioned hooking part 63 of the link-wires 60 hangs with the neighboring parts of the end portions of the claws 50, it is possible to avoid the use of a large rotation stroke of the claws 50.

According to the preferred embodiments discussed above, as the remedy motion of the covered electric wire W can be carried out in a state in which the claws 50 approach both molds 1 and 2 as nearly as possible when the claws 50 move with the displacement of the shank 3, the link-wires 60 can remedy the posture of the covered electric wire W at a desired position without carrying out a complicated folding process with respect to the claws 50. Further, as it is possible to avoid a big rotational stroke of the claws 50, it is also possible to avoid the need for a wide supply path of an electric wire when the covered electric wire W is supplied to the terminal application device A, and as a result, there is the added advantage that the range of the applicable supply units of an electric wire becomes relatively wide. In addition as the claws 50 are connected with the shank 3 by the link-wires 60 by a simple mechanism having a relatively simple structure, it is possible to easily adapt the invention to many kinds of terminal application devices A, and practical usability is therefore relatively high. Further advantageously, the numbers of parts decrease and manufacturing costs are lowered.

Further, as both claws 50 nip the covered electric wire W, the claw 50 can position the covered electric wire W, regardless of the members already installed on the terminal application device A, and as a result, there is an additional advantage that the positioning of the covered electric wire W becomes more accurate.

Further, as the setting members 70 always set the above-mentioned claws 50 to the remedy posture, the claws 50 are relatively constantly retained by the hooking part 63 of the link-wires 60; therefore, there are merits that the linking structure is stabilized and reliability becomes high.

Therefore, in the preferred embodiment described above, a remarkable ability to carry out the positioning of the covered electric wire having a wide usability at a low cost is achieved.

Figure 3:
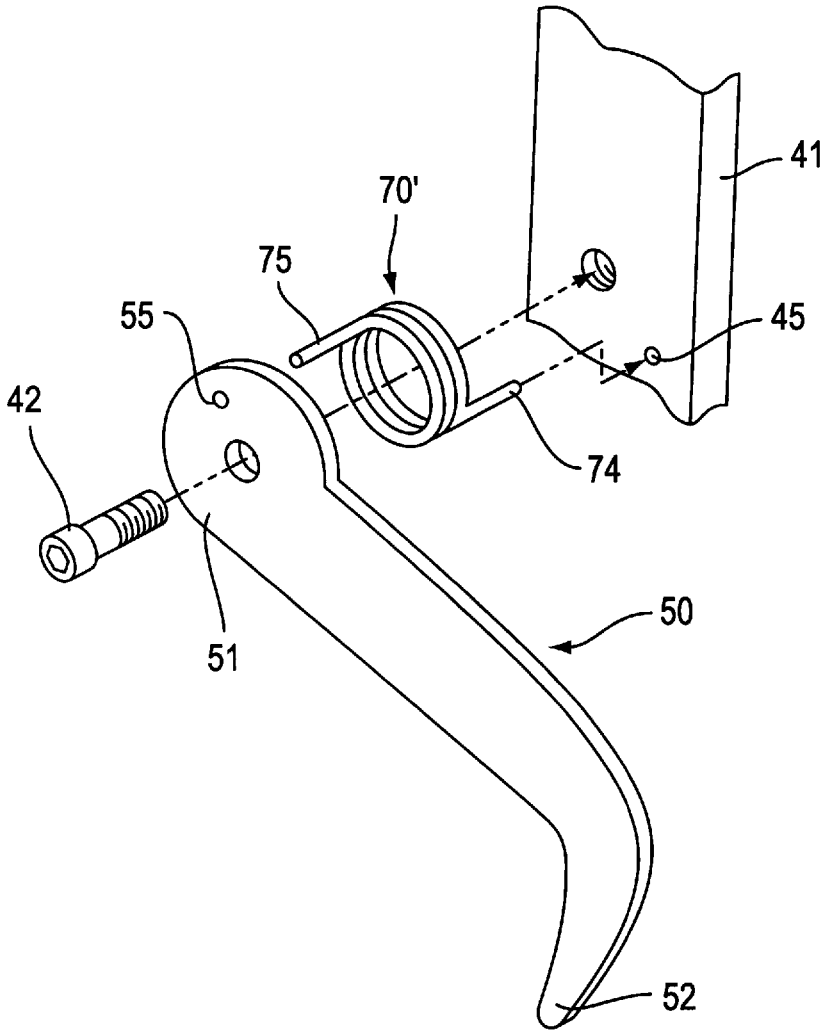
FIG. 3 is an exploded perspective view, showing the principal of another embodiment of the present invention in expansion.
Figure 4:
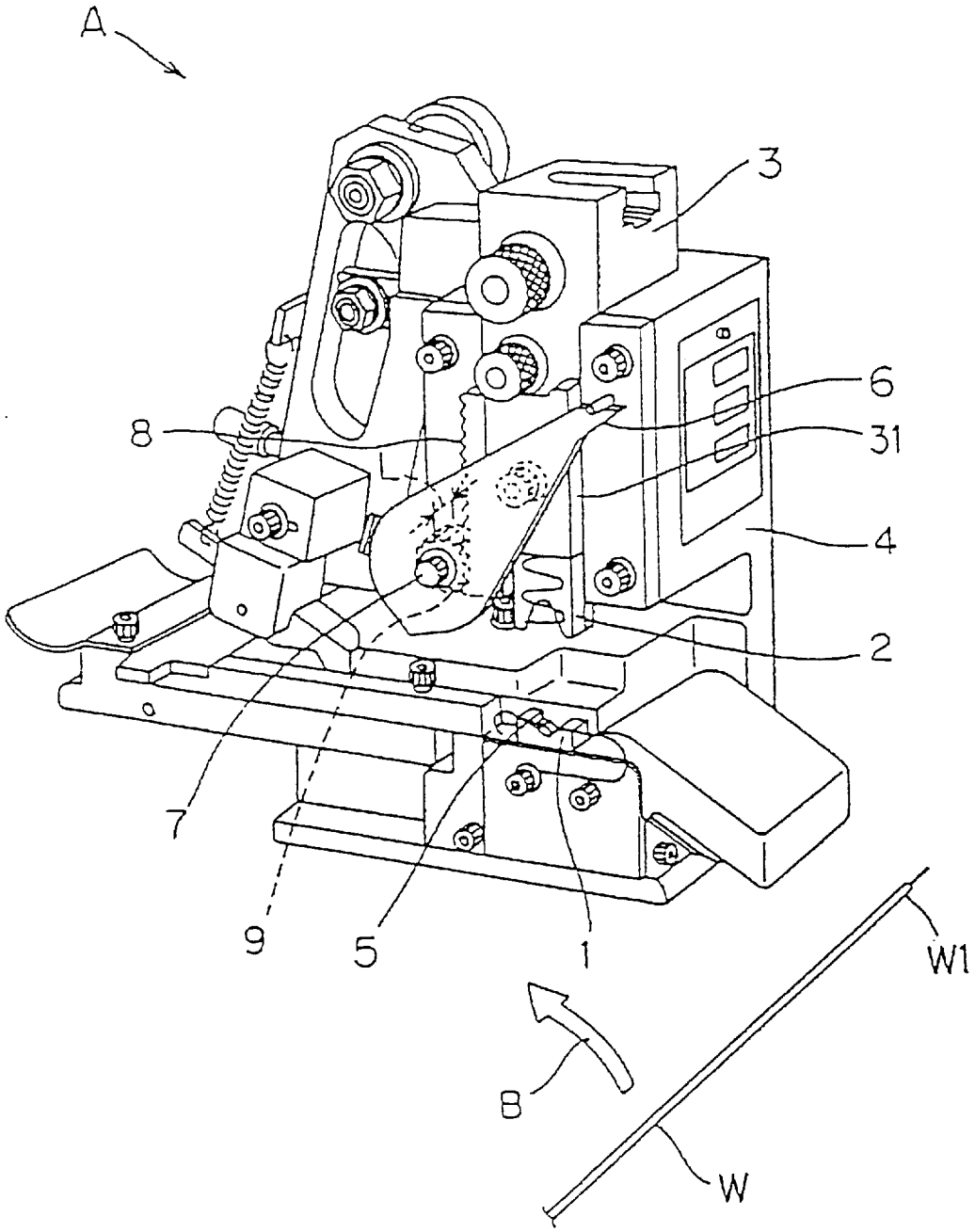
FIG. 4 is a front schematic view of a conventional device for positioning or remedying an electric wire posture which is adapted to a conventional terminal application device.
Figure 5:
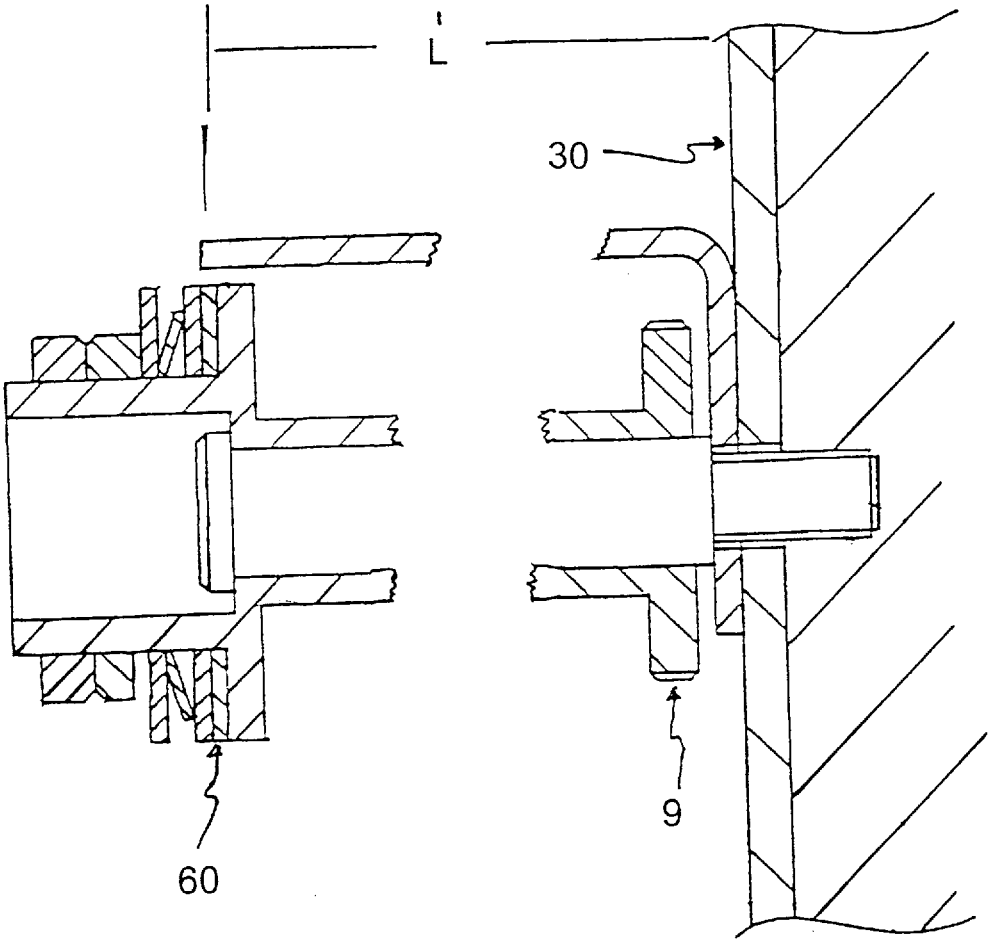
FIG. 5 is a schematic cross-section view of a portion of FIG. 4, with a portion broken away.

Alternatively, as shown in the FIG. 3, it is possible to employ a torsion coil spring, for example, as the setting members. In such case, the assembly can be easily performed, because the fit-in holes 45 and 55 in which the both end portions 74 and 75 of the torsion coil springs 70 are fit in are respectively formed in the cover plate 41 and the base end portions 51 of the claws 50.

As illustrated above, according to the present invention, when the claws link with the displacement of the shank in the linking procedure, the remedy motion of the covered electric wire W can be carried out in a state in which the claws approach the molds as nearly as possible. Therefore, the posture of the covered electric wire at a normal position without carrying out a complicated folding process on the claws can be remedied. Further, as it is possible to settle a big rotational stroke of the claws, it is possible to settle a wide supply path of an electric wire when the covered electric wire is supplied to the terminal application device and as a result, there are merits that the range of the applicable supply unit of an electric wire becomes wide and practical usability becomes high. Further, there is a merit that the numbers of parts decrease and process cost is lowered.

Further, when the setting members for always setting the above-mentioned claws to the remedy posture, the claws are hardly removed from the hooking part of the link-wires, therefore there the linking structure is stabilized and reliability becomes high.

Therefore, according to the present invention, a remarkable effect enabling to carry out the posture remedy of the covered electric wire having a wide usability at a low cost is exhibited.

As will be appreciated, the preferred embodiment described is merely illustrative and is not intended to be limited thereto. For example, springs need not be employed, and only the force of gravity need by employed to urge the ends 52 of the claws 50 downwardly. Thus, the ends 52 of the claws can be in a free-fall condition, retained by hook or gaff part 63.

The present disclosure relates to subject matter contained in Japanese priority patent application No. JP 8-335963

(filed on Dec. 16, 1996) which is hereby expressly incorporated by reference in its entirety.

What is claimed is:

1. An apparatus for positioning an electric wire within a terminal application system for installing an electric terminal on an electric wire, wherein the terminal application system comprises a stationary mold, a movable mold connected to a shank member for moving the moveable mold and capable of moving the moveable mold toward the stationary mold, and a stationary shank holder for holding the shank member while allowing relative movement between the shank member and the stationary shank holder, the apparatus for positioning an electric wire comprising:

at least one claw, having a fixed axis of rotation and a longitudinal axis extending generally transversely from the axis of rotation, and being pivotally connected to the stationary shank holder through the fixed axis of rotation so that the claw is free to rotate about the fixed axis of rotation with respect to the stationary shank holder while connected to the stationary shank holder, and being rotatable from a wire positioning position to an open position; and a support member connected to the shank, supporting the claw and allowing the claw to move from the open position to the wire positioning position when the shank and moveable mold are moved toward the stationary mold.

2. The apparatus of claim 1, wherein the shank comprises a longitudinal axis, and the shank and moveable mold are moved along an axis of movement when moved toward the stationary mold which is generally parallel to the longitudinal axis of the shank, and the apparatus for positioning the electric wire comprises a first and second claw, the first claw being pivotally connected to the stationary shank holder at a first side of the longitudinal axis of the shank, and the second claw being pivotally connected to the stationary shank holder at a second side of the longitudinal axis of the shank.

3. The apparatus of claim 2, wherein the first claw and the second claw are generally symmetrically disposed on opposite sides of the longitudinal axis of the shank.

4. The apparatus of claim 1, wherein the at least one claw is biased toward the wire positioning position.

5. The apparatus of claim 4, wherein the at least one claw is biased toward the wire positioning position by gravity.

6. The apparatus of claim 4, wherein the at least one claw is biased toward the wire positioning position by at least a torsion spring operatively interconnected between the at least one claw and the stationary shank holder.

7. The apparatus of claim 6, wherein the torsion spring at least partially encircles the axis of rotation of the at least one claw.

8. The apparatus of claim 4, wherein the at least one claw is biased toward the wire positioning position by at least a tension spring operatively interconnected between the at least one claw and the stationary shank holder.

9. The apparatus of claim 8, wherein the tension spring comprises an axis which is generally transverse to the axis of rotation of the at least one claw.

10. The apparatus of claim 9, wherein the shank comprises a longitudinal axis and the axis of the tension spring is generally parallel with the longitudinal axis of the shank.

11. The apparatus of claim 1, wherein the support member comprises a generally U-shaped gaff connected to the shank and operatively engaging the claw for movement between the open position and the wire positioning position.

12. An apparatus for positioning an electric wire within a terminal application system for installing an electric terminal on an electric wire, wherein the terminal application system comprises a stationary mold, a movable mold connected to a shank member for moving the moveable mold and capable of moving the moveable mold toward the stationary mold, the shank member having a first side and a second side, and a stationary shank holder for holding the shank member at the first and second sides of the shank member while allowing relative sliding movement between the shank member and the stationary shank holder, the apparatus for positioning an electric wire comprising:

at least one claw, having a fixed axis of rotation and a longitudinal axis extending generally transversely from the fixed axis of rotation, and being pivotally connected to the stationary shank holder through the fixed axis of rotation so that the claw is free to rotate about the axis of rotation with respect to the stationary shank holder while connected to the stationary shank holder, and being rotatable from a wire positioning position to an open position;

and a support member connected to the shank supporting the claw and allowing the claw to move from the open position to the wire positioning position when the shank and moveable mold are moved toward the stationary mold.

13. The apparatus of claim 12, wherein the stationary shank holder comprises a first portion receiving the first side of the shank and a second portion receiving the second side of the shank, and the apparatus for positioning the electric wire comprises a first and second claw, wherein the first claw is pivotally connected to the first portion of the stationary shank holder and the second claw is pivotally connected to the second portion of the stationary shank holder.

14. The apparatus of claim 13, wherein the first and second claws are biased toward the wire positioning position by gravity.

15. The apparatus of claim 13, wherein the support member comprises a gaff connected to the shank and operatively engaging the claw for movement between the open position and the wire positioning position.

16. The apparatus of claim 13, wherein the first and second claws are biased toward the wire positioning position by at least a torsion spring operatively interconnected between each claw and the stationary shank holder.

17. The apparatus of claim 16, wherein the apparatus comprises two torsion springs, each torsion spring at least partially encircles the axis of rotation of a respective claw.

18. The apparatus of claim 13, wherein the first and second claws are biased toward the wire positioning position by at least a tension spring operatively interconnected between each claw and the stationary shank holder.

19. The apparatus of claim 18, wherein the tension spring comprises an axis which is generally transverse to the axis of rotation of each claw.

20. The apparatus of claim 12, wherein the support member comprises a gaff connected to the shank and operatively engaging the claw for movement between the open position and the wire positioning position.

21. The apparatus of claim 13, wherein the first and second claws are biased toward the wire positioning position.

* * * * *

UNITED STATES PATENT AND TRADEMARK OFFICE

CERTIFICATE OF CORRECTION

PATENT NO. : 5,890,280

DATED : April 6, 1999

INVENTOR(S) : S. MATSUZAWA

It is certified that error appears in the above-identified patent and that said Letters Patent is hereby corrected as shown below:

At column 10, line 37 (claim 14, line 1) of the printed patent, "13" should be ---21---.

At column 10, line 44 (claim 16, line 1) of the printed patent, "13" should be ---21---.

At column 10, line 51 (claim 18, line 1) of the printed patent, "13" should be ---21---.

Signed and Sealed this

Fifth Day of September, 2000

*Attest:*

Q. TODD DICKINSON

*Attesting Officer*

*Director of Patents and Trademarks*